US005134987A

United States Patent [19]

Mayer et al.

[11] Patent Number: 5,134,987

[45] Date of Patent: Aug. 4, 1992

[54] IGNITION CIRCUIT MONITORING IN AN INTERNAL COMBUSTION ENGINE

[75] Inventors: Ulrich Mayer, Waiblingen; Karl Ott, Markgroeningen; Joerg Fuchs, Schwieberdingen; Immanuel Krauter, Erbstetten, all of Fed. Rep. of Germany

[73] Assignee: Robert Bosch GmbH, Stuttgart, Fed. Rep. of Germany

[21] Appl. No.: 701,786

[22] Filed: May 17, 1991

[30] Foreign Application Priority Data

May 21, 1990 [DE] Fed. Rep. of Germany ..... 4016307

[51] Int. Cl.[5] ..... F02P 17/00; F02P 11/06; F02P 3/04

[52] U.S. Cl. ..... 123/644; 123/630

[58] Field of Search ..... 123/609, 610, 611, 623, 123/625, 644, 651, 652, 630

[56] References Cited

U.S. PATENT DOCUMENTS

| | | | |
|---|---|---|---|
| 3,938,490 | 2/1976 | Snyder et al. | 123/644 X |
| 4,114,582 | 9/1978 | Rabus et al. | 123/644 X |
| 4,117,819 | 10/1978 | Jarrett et al. | 123/644 X |
| 4,452,220 | 6/1984 | Minner | 123/644 |
| 4,915,086 | 4/1990 | Ciliberto et al. | 123/644 X |
| 4,977,883 | 12/1990 | Koiwa | 123/644 |

FOREIGN PATENT DOCUMENTS

| | | | |
|---|---|---|---|
| 0209667 | 10/1985 | Japan | 123/644 |
| WO89/08778 | 9/1989 | PCT Int'l Appl. . | |

OTHER PUBLICATIONS

Robert Bosch GmbH, Automotive Handbook, 2nd English Edition, Delta Press Ltd/Society of Automotive Engineers, p. 407. Jan. 1986.

*Primary Examiner*—Willis R. Wolfe

*Attorney, Agent, or Firm*—Frishauf, Holtz, Goodman & Woodward

[57] ABSTRACT

The invention relates to ignition circuit monitoring in an internal combustion engine, where a sensor signal is generated in the course of each ignition by an ignition current sensor (5), which is supplied via a pulse shaper (6) to a memory unit (7). An ignition computer (4) reads out the contents of the memory following each ignition or each sensor signal and resets the memory unit (7) prior to the next ignition. Thus, when the sensor signal is missing, the ignition computer (4) detects the lack of ignition and an appropriate control signal is made available for control actions.

9 Claims, 2 Drawing Sheets

IGNITION CIRCUIT MONITORING IN AN INTERNAL COMBUSTION ENGINE

FIELD OF THE INVENTION

The invention relates generally to a distributorless ignition system for an internal combustion engine (I.C.E.) and, more particularly, to an improved circuit for monitoring such a system.

Specifically, it relates to ignition circuit monitoring in an internal combustion engine with a plurality of ignition coils, each one composed of a primary coil and a secondary coil, where the primary coil is connected with its first primary connector to a primary current supply and with its second primary connector to an ignition end stage (power semiconductor), where the secondary coil is connected with its first secondary connector with a spark plug and with its second secondary connector with the ground via an ignition current sensor, and where a pulse shaper is connected downstream of the ignition current sensor and a memory unit and an ignition computer in the form of a microcomputer are connected to the pulse shaper.

BACKGROUND OF THE INVENTION

Distributor-less ignition systems for internal combustion engines are commonly known. In place of a rotating mechanical distributor for the ignition voltage, distribution is performed electronically in connection with the control of the fuel injection system for each cylinder and synchronously with the RPM and the operational condition of the internal combustion engine. Ignition coils are driven in a known, distributor-less ignition system and two ignition voltages are simultaneously generated, by means of which one ignition takes place in a suitable manner during the power stroke and the other ignition takes place during the exhaust stroke of another cylinder. Therefore it is necessary to designate the cylinder in which ignition takes place during the power stroke.

A recognition apparatus for the determination of this cylinder is known, for this purpose, from PCT/EP 88/00221, by present co-inventor Krauter and his co-inventor Klötzner, where an ignition current sensor is disposed in each spark plug wire, downstream of which a pulse shaper, a memory unit and an ignition computer are connected. Nothing more than the detection and association of the ignition signal at the cylinder with the power stroke is performed by means of this arrangement.

SUMMARY OF THE INVENTION

By means of the ignition circuit monitoring in accordance with the invention, a sensor signal is generated by the ignition voltage sensor during each ignition and is supplied to the memory unit via the pulse shaper. The ignition computer reads out the contents of the memory after each ignition or during each ignition signal and resets the memory prior to each following ignition. Thus, the fact that ignition has been performed is detected by the ignition computer in case of a missing sensor signal or when the memory is empty. In this case, an appropriate control signal is made available by the ignition computer for control actions.

In an advantageous embodiment of the invention, no more than one ignition current sensor is required for all ignition circuits for detecting the lack of ignition, which is disposed in a distribution line for all second secondary connections or in a common primary power supply line for all ignition coils.

The invention will be explained in detail by means of the drawings.

BRIEF FIGURE DESCRIPTION

FIG. 1 is a block diagram of a first embodiment of an ignition circuit monitor with an ignition current sensor in a distribution line for the second secondary connectors of the ignition coils; and FIG. 2 is a block diagram of a second embodiment of an ignition circuit monitor with an ignition current sensor in a common primary current supply line for the ignition coils.

DETAILED DESCRIPTION

Figure 1:
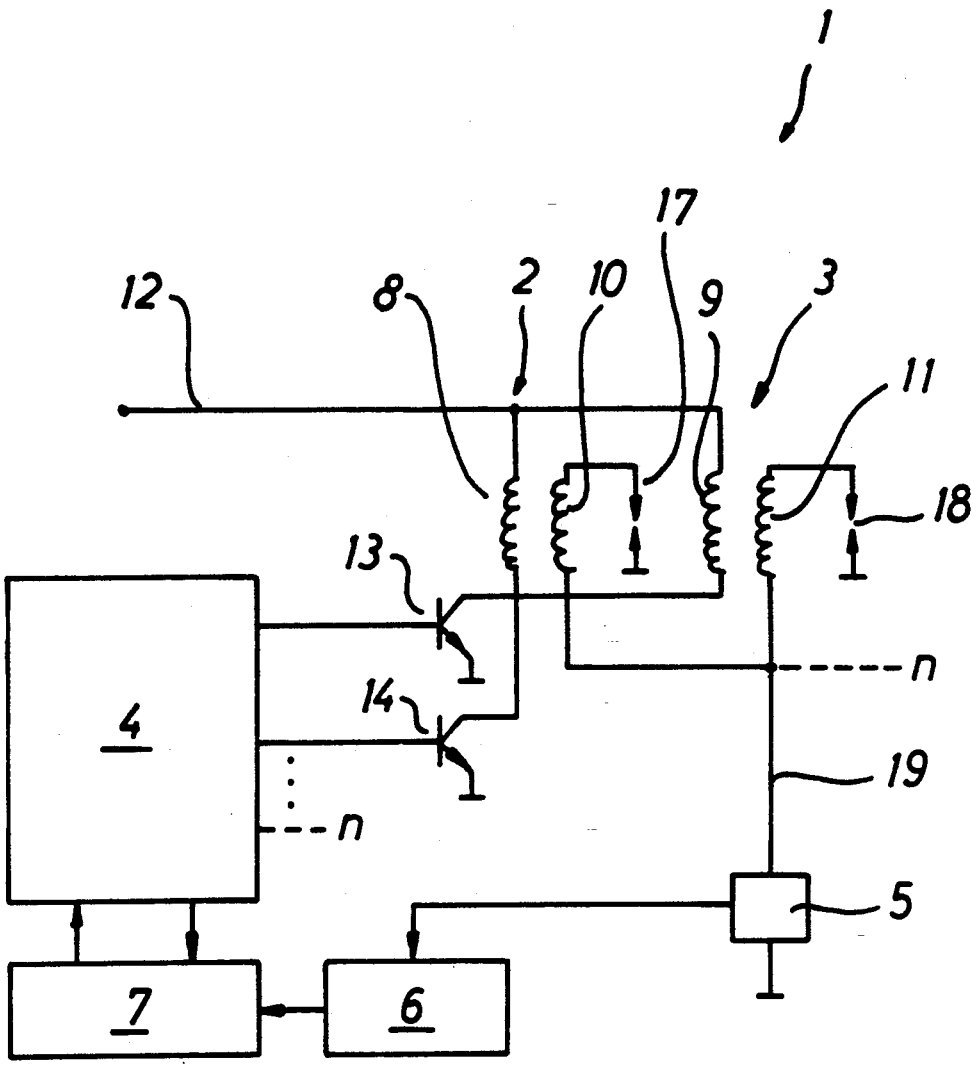
Figure 2:
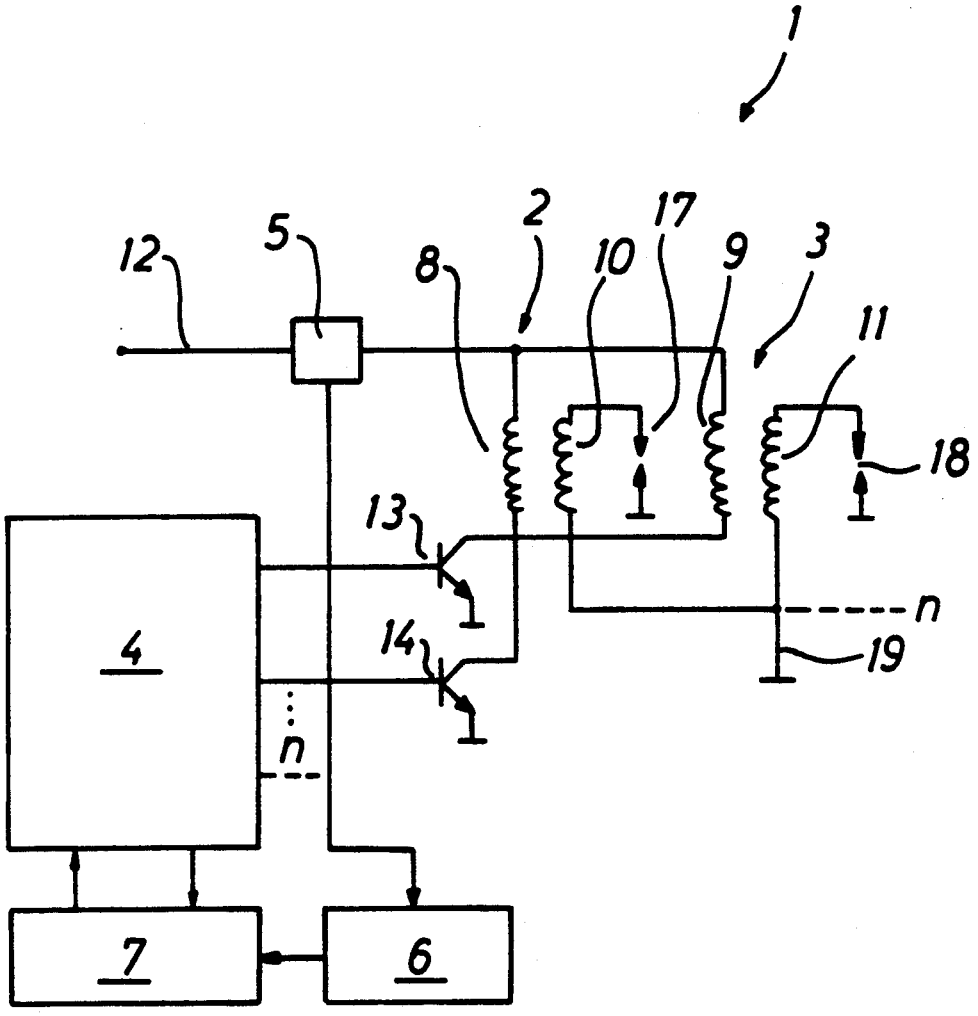

In each one of FIGS. 1 and 2, there is shown a distributor-less ignition device 1 with ignition circuit monitoring, consisting of ignition coils 2, 3, a microcomputer for the engine control, which also contains an ignition computer 4, an ignition current sensor 5, a pulse shaper 6 and a memory 7.

Only two ignition coils 2, 3 are shown in the drawing; in the actual embodiment there are as many ignition coils n as there are cylinders.

Each ignition coil 2, 3 . . . n consists of a primary coil 8, 9 and a secondary coil 10, 11. The first primary connectors of the primary coils 8, 9 are combined in the form of a common primary current supply line 12. The second primary coil connectors are connected with the ignition computer 4 via associated ignition end stages 13, 14, which are shown as power transistors.

The first secondary connectors of the secondary coils 10, 11 are connected to associated spark plugs 17, 18. The second secondary connectors are combined in a distribution line 19 and connected to the ground. The ignition current sensor 5 is in the form of an inductive or capacitive sensor or of an ohmic resistor. The pulse shaper 6 is connected downstream of the ignition current sensor 5 and is connected with the memory 7. The memory 7 cooperates with the ignition computer 4. Memory 7 and computer 4 may be of conventional construction, such as the INTEL components disclosed in prior BOSCH patents and publications, but other brands are also suitable.

Depending on the particulars of the situation, the ignition current sensor 5 can either be disposed on the distribution line 19 for the second secondary connectors (embodiment in accordance with FIG. 1) or on the common primary current supply line 12 (embodiment in accordance with FIG. 2).

In both embodiments, the ignition current sensor 5 receives usable signals, which can be further processed in a suitable manner in the pulse shaper 6 connected downstream of the sensor.

The ignition devices, with ignition circuit monitoring shown, have been assigned the following functions:

During each ignition by means of one of the ignition coils 2, 3 . . . n, a current pulse flows through the primary current supply line 12 or the distribution line 19, because of which a sensor signal is generated by the ignition current sensor and supplied to the pulse shaper 6 connected downstream of it. Following appropriate pulse shaping, for example into a rectangular signal, the sensor signal is supplied to memory 7.

The ignition computer 4 reads out the contents of the memory following each ignition or each sensor signal, and resets the memory prior to the next ignition. The ignition computer 4 detects a lack of ignition if the sensor signal is missing and it is possible to initiate appropriate steps in the internal combustion engine by outputting a control signal.

| | |
|---|---|
| A suitable microprocessor 4 is model available from the company: | MP 8097<br>INTEL |
| A suitable ohmic resistor sensor 5 is model available from the company: | R 470 |
| A suitable inductive sensor 5 is model available from the company: | some windings over resistor<br>BOSCH-Nr. 0 356 914 222 |
| A suitable pulse shaper 6 is model available from the company: | resistor-capacitor-link<br>band pass |
| A suitable memory 7 is model available from the company: | FF-Input of MP 8097<br>INTEL |

What is claimed is:

1. An ignition circuit monitoring device for an internal combustion engine with a plurality of ignition coils, each one composed of a primary coil (8,9) and a secondary coil (10,11), where the primary coil is connected with its first primary connector to a primary current supply line (12) and with its second primary connector to an ignition end stage (13, 14) or power semiconductor, where the secondary coil is connected with its first secondary connector with a spark plug and with its second secondary connector with the ground, and where a pulse shaper (6) is connected downstream of the ignition current sensor (5) and a memory (7) and an ignition computer in the form of a microcomputer (4) are connected to the pulse shaper, wherein an ignition current sensor (5) is located in a common primary current supply line (12) for all ignition coils (2, 3 . . . n);

a sensor signal is generated in the course of each ignition by the ignition current sensor (5), which signal is fed via the pulse shaper (6) to said memory (7);

said ignition computer (4) reads out the contents of said memory following each ignition or each sensor signal and resets said memory (7) prior to the next ignition and wherein, when the sensor signal is missing, the ignition computer (4) detects the lack of ignition and generates a control signal.

2. An ignition circuit monitoring device according to claim 1, wherein said ignition current sensor (5) is an inductive sensor.

3. An ignition circuit monitoring device according to claim 1, wherein said ignition current sensor (5) is an ohmic resistor.

4. An ignition circuit monitoring device for an internal combustion engine with a plurality of ignition coils, each one composed of a primary coil (8,9) and a secondary coil (10,11), where the primary coil is connected with its first primary connector to a primary current supply (12) and with its second primary connector to an ignition end state (13, 14) or power semiconductor, where the secondary coil (11) is connected with its first secondary connector with a spark plug (18) and with its second secondary connector (19) with the ground via an ignition current sensor (5), and where a pulse shaper (6) is connected downstream of the ignition current sensor (5) and a memory (7) and an ignition computer in the form of a microcomputer (4) are connected to the pulse shaper, wherein a sensor signal is generated in the course of each ignition by the ignition current sensor (5), which signal is fed via the pulse shaper (6) to said memory (7);

said ignition computer (4) reads out the contents of said memory following each ignition or each sensor signal and resets said memory (7) prior to the next ignition and wherein, when the sensor signal is missing, the ignition computer (4) detects the lack of ignition and generates a control signal.

5. An ignition circuit monitoring device according to claim 4, wherein said ignition current sensor (5) is an inductive sensor.

6. An ignition circuit monitoring device according to claim 4, wherein said ignition current sensor (5) is an ohmic resistor.

7. An ignition circuit monitoring device according to claim 4, wherein all secondary connectors of the ignition coils (2, 3 . . . n) are combined and an ignition current sensor (5) is located in a corresponding distribution line (19).

8. An ignition circuit monitoring device according to claim 7, wherein said ignition current sensor (5) is an inductive sensor.

9. An ignition circuit monitoring device according to claim 7, wherein said ignition current sensor (5) is an ohmic resistor.

* * * * *